United States Patent [19]

James et al.

[11] 4,177,754

[45] Dec. 11, 1979

[54] APPARATUS FOR OBTAINING BRIGHT FINISH GALVANIZING COATING ON WIRE

[75] Inventors: William L. James; Alex P. Wonso, both of Homewood, Ill.

[73] Assignee: Fennell Corporation, Harvey, Ill.

[21] Appl. No.: 910,185

[22] Filed: May 30, 1978

[51] Int. Cl.[2] ..... C23C 1/02

[52] U.S. Cl. ..... 118/47; 118/67; 118/69; 427/225; 427/367; 427/374 D; 427/398 B; 427/433

[58] Field of Search ..... 427/374 P, 374 A, 374 B, 427/374 C, 374 D, 374 E, 398 B, 225, 321, 433, 329, 376 H, 357, 367, 431, 432; 118/69, 47, 67

[56] References Cited

U.S. PATENT DOCUMENTS

| | | | |
|---|---|---|---|
| 2,010,941 | 8/1935 | Bradley | 118/69 X |
| 2,080,518 | 5/1935 | Underwood | 427/357 |
| 2,166,250 | 7/1939 | Herman | 427/398 B |
| 3,203,826 | 8/1965 | Stobierski | 427/398 B |
| 3,260,577 | 7/1966 | Mayhew | 427/225 X |
| 3,284,892 | 11/1966 | Wade | 427/357 X |
| 3,323,940 | 6/1967 | Sievert | 427/433 X |
| 3,743,535 | 7/1973 | Padjen et al. | 427/398 B |
| 3,941,906 | 3/1976 | Bostroem | 427/433 X |

*Primary Examiner*—Ralph S. Kendall

*Attorney, Agent, or Firm*—Trexler, Wolters, Bushnell & Fosse, Ltd.

[57] ABSTRACT

A method and apparatus utilized in conjunction with a wire galvanizing apparatus assures a bright finish on the coated wire. This method and apparatus includes passing the wire through a water quenching bath immediately following the emergence of wire from the molten zinc galvanizing bath of a conventional galvanizing apparatus. A pair of pressure pads grips the wire at its entrance to the water quenching bath for substantially sealing the water quenching bath against water leakage into the adjacent molten zinc galvanizing bath. A heating apparatus is directed at the wire prior to its entrance to the pressure pads to assure that the zinc coating is still in a molten condition as the wire enters the water quenching bath.

5 Claims, 6 Drawing Figures

APPARATUS FOR OBTAINING BRIGHT FINISH GALVANIZING COATING ON WIRE

BACKGROUND OF THE INVENTION

This invention is directed generally to the zinc galvanizing arts and more particularly to a new and improved method and apparatus for obtaining a bright finish on zinc galvanized wire.

In many applications it is desirable to provide a bright finish on galvanized wire, as opposed to the relatively dull surface appearance normally imparted during the conventional galvanizing process. For example, where the wire is visible in the products and/or situations in which it is utilized, it is often considered desirable to have a bright or shiny finish.

It is known in the prior art that such a bright or shiny appearance or finish may be obtained by water quenching the wire while the zinc coating applied thereto in the galvanizing process is still in a molten condition. However, many problems have been encountered in facilitating such water quenching in conjunction with the conventional galvanizing process and apparatus. For example, such water quenching requires that the wire be delivered from the surface of the molten zinc galvanizing bath to the water quenching mechanism very rapidly, before the zinc coating has had a chance to cool and solidify. If the zinc coating should begin to solidify prior to reaching the water quenching apparatus, the water quenching will not perform its desired function and the finish will be dull.

In one prior art system a water quenching tank is positioned in close proximity to the surface of the molten zinc galvanizing bath. Such installations have met, however, with a number of problems and disadvantages. For example, in many such installations extensive modifications were required in the structure of the conventional galvanizing apparatus. In many cases, the walls of the zinc bath were modified to provide access for water pipes or the like at a sufficiently close level to the exit point of the wire from the surface of the molten zinc. Such modifications are generally difficult and expensive. Moreover, such arrangements introduce a distinct possibility of leakage of water from the quenching bath into the molten zinc with resultant explosive vaporization. Moving the water quenching bath far enough from the surface of the molten zinc to prevent such water leakage generally results in excessive degree of resolidification of the zinc coating before the wire reaches the water quenching bath. In another prior art device, a seal for water leakage prevention, through which the zinc coated wire passes prior to entering the water quenching bath, causes accretion of a "blob" or globule of molten zinc at the entrance of the seal as the wire passes through. This accretion of molten zinc at the entrance to the sealing mechanism tends to resolidify as it grows in size, thus offering undesireable resistance to the feeding of the wire through the galvanizing apparatus, to the point of causing breakage of the wire. This is clearly undesirable as it would require shutdown of the apparatus to restart wire therethrough in a continuous strand, in the conventional fashion.

OBJECTS AND SUMMARY OF THE INVENTION

Accordingly, the present invention provides a new and improved apparatus for obtaining a bright finish on galvanized wire.

A more specific object of the invention is to provide a new and improved method and apparatus of the foregoing type adapted for utilization in conjunction with the conventional wire galvanizing process and apparatus, requiring but a minimum of modifications thereto.

Another object is to provide a method and apparatus of the foregoing type which is further adapted to assure that the zinc coating on the wire is maintained in a molten condition up to the beginning of the water quenching process.

Yet another object is to provide a method and apparatus of the foregoing type which is further adapted to substantially prevent leakage of water from the water quenching process and apparatus into the molten zinc bath.

Briefly, in accordance with the foregoing objects a method for obtaining a bright finish galvanized coating on wire comprises the steps of passing molten zinc coated wire through a water quenching bath substantially immediately following passage of the wire through a molten zinc galvanizing bath, while substantially preventing water from said water quenching bath from entering the zinc bath, and heating the zinc coated wire intermediate the zinc bath and water quenching bath at a location which insures maintaining the zinc coating in a molten condition as the wire enters the water quenching bath.

Apparatus for carrying out this method includes water quenching means for quenching the wire while the zinc coating is still in a molten condition, said water quenching means being mounted for receiving said wire following its passage through a molten zinc bath, and heating means interposed between the water quenching means and the molten zinc bath for maintaining the zinc coating on the wire in a molten condition until the wire enters the water quenching means.

Other objects, features and advantages of the present invention will be more readily appreciated upon consideration of the following detailed description, together with the accompanying drawings.

DETAILED DESCRIPTION OF THE ILLUSTRATED EMBODIMENT

Figures 1, 2, 3:
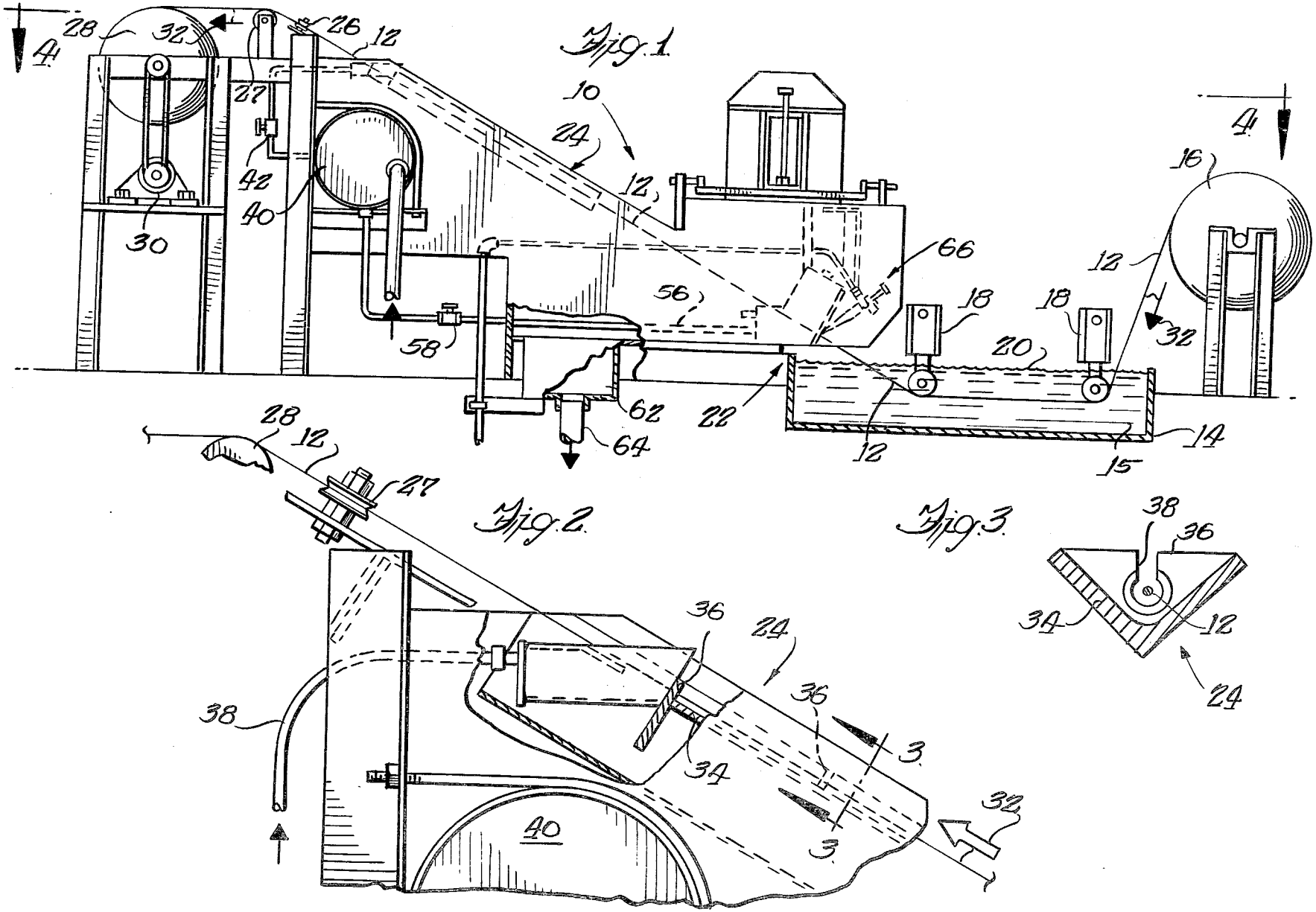
FIG. 1 is a side elevation of a conventional wire galvanizing apparatus, in which apparatus according to the invention is advantageously embodied.
FIG. 2 is an enlarged view, partially in section and partially cut away, of a portion of the apparatus of FIG. 1.
FIG. 3 is a further enlarged view taken generally along the lines 3—3 of FIG. 2.

Referring now to the drawings, and initially to FIGS. 1 through 4, there is seen a conventional wire galvanizing apparatus, designated generally 10. The apparatus 10 is preferably, as shown in the plan view of FIG. 4, one for simultaneously galvanizing a plurality of strands of wire 12. In accordance with conventional practice, a zinc pot 14 holds a supply of molten zinc 15, the pot 14 generally being on the order of one and one half feet deep and ten to fifteen feet in length. A supply reel 16 for holding a supply of wire 12 to be galvanized is mounted at one end of the zinc pot. The wire 12 from the supply reel 16 is guided around a conventional guide mechanism 18 so as to advance substantially horizontally through the molten zinc 15 to be coated. A further similar guide mechanism 18 serves to guide and direct the wire upwardly from a surface 20 of the molten zinc 15 and to the water quenching means of the present invention, designated generally 22. Advantageously, the water quenching means 22 is relatively easily incorporated in the galvanizing apparatus 10.

After leaving the water quenching means the wire 12 is fed through a conventional water cooling apparatus designated generally 24 and over suitable guide means 26 and 27 to a take up reel 28 which is driven by a motor 30 or other suitable means. The direction of travel of the wire 12 through the apparatus 10 is indicated by arrows 32.

Figure 4:
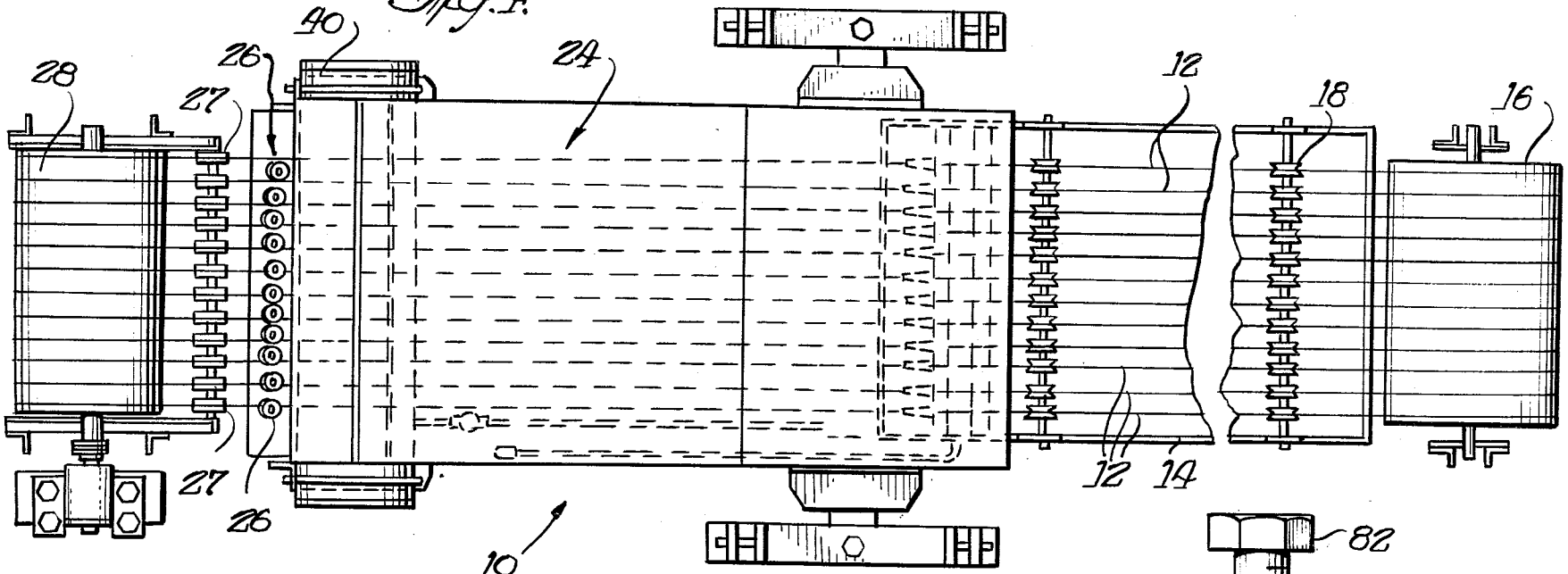
FIG. 4 is a top plan view of the apparatus of FIG. 1.

As illustrated in FIG. 4, the apparatus 10 simultaneously galvanizes a plurality of wires 10, by the provision of a plurality of guide members 18, 26 and 27, and a similar plurality of cooling devices 24, the width of the zinc pot or bath 14 being sufficient to accommodate such plurality of wires 12. Water quenching means 22 is also provided for each wire 12.

It will be understood that the purpose of the cooling device 24 is only to reduce the temperature of the coated wire 12 for handling purposes. In this regard, and with reference to FIGS. 2 and 3, it will be seen that a typical cooling apparatus 24 comprises an inclined trough 34 having a plurality of water cascading weirs 36, formed with keyhole-like slots 38 through which the wire 12 is guided. Water is supplied at the upper ends of the troughs 34 by suitable water supply lines or conduits 38, which are fed from a manifold 40 via a suitable valve 42.

Figure 5:
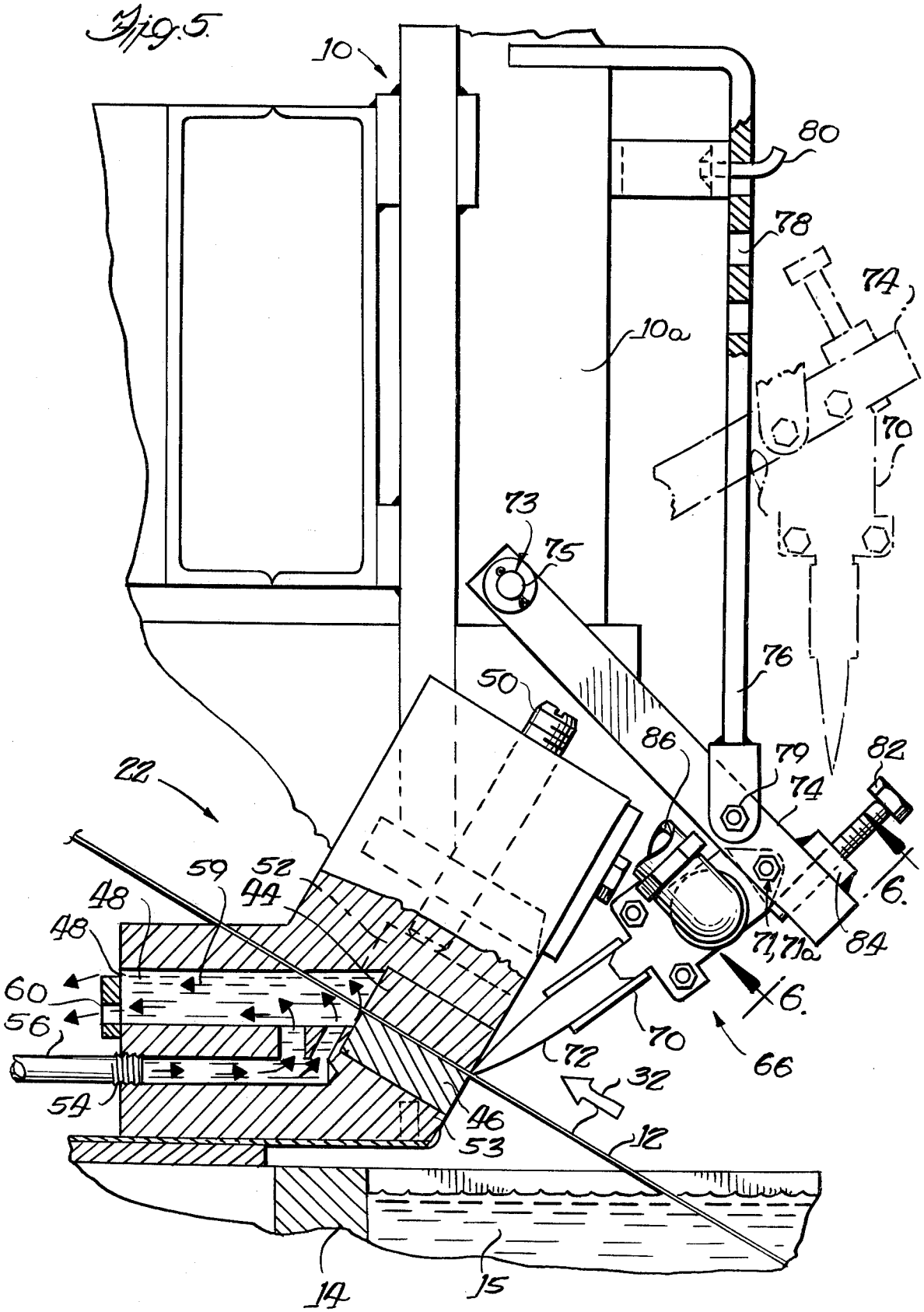
FIG. 5 is an enlarged side elevation, partially in section and partially broken away, of a portion of the apparatus of FIG. 1, illustrating parts of the apparatus according to this invention.

Referring now more particularly to the water quenching means 22, and also to FIG. 5, it will be seen that each wire 12 is initially directed through a pair of pads 44, 46, preferably of asbestos, which engage the wire 12. These pads 44 and 46 are urged against the wire 12 to form a seal at the entrance to a waterfilled quenching tank 48 so as to substantially prevent any of the water 49 in the tank 48 from leaking into the molten zinc 15 in the bath 14 therebelow. Moreover, this wiping action of pads 44 and 46 serves to remove any excess molten zinc from the surface of the wire 12, to maintain a substantially constant thickness or gauge of wire 12. It will be understood in this regard that the pads 44, 46 do not reduce the thickness of the coating of the wire 12 beyond the desired gauge. Accordingly, a suitable amount of pressure or force is applied to the pads 44 and 46 by means of an adjustable screw member 50. This screw member abuts a mounting member or bracket 52 for the pad 44, the pad 46 being held stationary by a second mounting member or bracket 53. Accordingly, the screw 50 is threadably adjustable for applying enough pressure to the pad 44 to insure the above-described sealing and wiping engagement of the pads 44 and 46 with the wire 12.

Cold water is delivered to an inlet 54 of the quenching tank 48 through a pipe 56 connected with a source or supply, such as the manifold 40, through a valve 58. It will be understood that a suitably partitioned tank 48 or separate tanks 48 are provided for each of the wires 12 to be quenched. In this regard a separate supply line 56 and cooperating shut off valve 58 is provided for each such tank or partition. The water 49 is continuously circulated in the direction indicated by arrows 59 and normally flows through a level controlled outlet 60 to a suitable sump 62 and drain 64.

In accordance with an important feature of the invention, a heating means or apparatus, designated generally 66, is located between the surface 20 of the molten bath 15 and the entrance to the pads 44 and 46. Advantageously, this heating means 66 assures that the zinc coating of the wire 12 remains in a molten condition as it enters the quenching tank 48 by way of the pads 44, 46. In an apparatus shown in FIG. 4 for treating a plurality of wires 12, a similar heating means or apparatus 66 is utilized for each wire 12. Hence, only one such heating means or apparatus 66 is illustrated and described herein.

Figure 6:
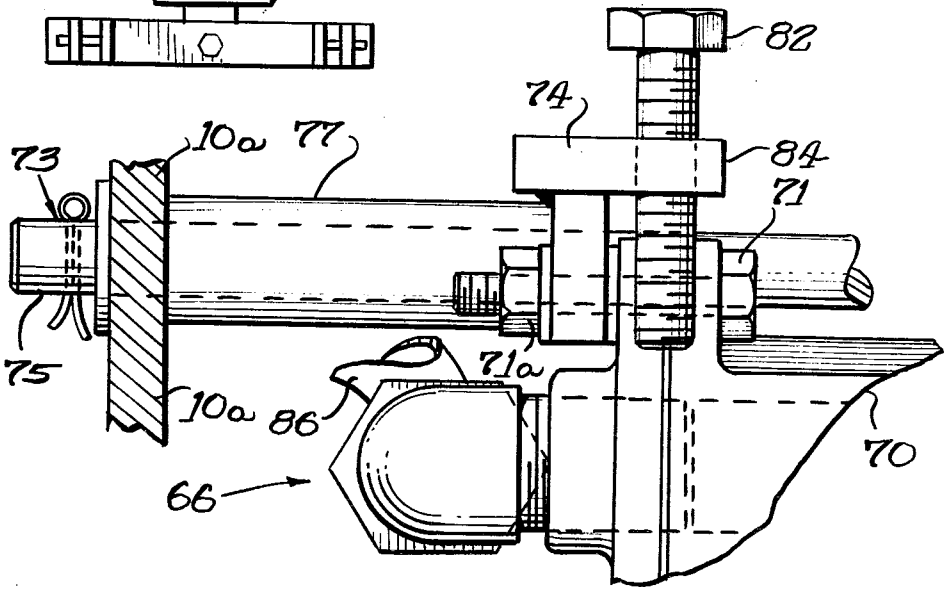
FIG. 6 is an enlarged view, partially in section and partially broken away, of a portion of the apparatus of the invention, taken generally in the plane of the line 6—6 of FIG. 5.

Referring to FIGS. 5 and 6, it will be seen that the heating apparatus 66 comprises a gas burner 70 which is positioned for directing a flame 72 onto the wire 12 in the vicinity of the entrance to the pads 44, 46. It will be appreciated that this further substantially prevents the solidification of any molten zinc that may build up or accumulate at the entrance of the wiping pads 44 and 46, a problem that was encountered in the prior art. Accordingly, stopping or breakage of the wire 12 as it is being drawn through the apparatus is substantially prevented.

The burner 70 is pivotally mounted by a suitable nut and bolt or the like 71, **71*a* upon a carrying bracket or bar 74 which has its opposite end pivotally mounted as indicated at reference numeral 73, upon the frame of the apparatus 10. This pivotal mounting 73 is accomplished by means of a shaft 75 rotatably engaged through a stationary wall portion 10*a* of the apparatus 10. A tubular spacer member 77 is provided between the wall 10*a* and the bracket 74 for holding the bracket and attached burner 70 in suitable lateral orientation for directing the flame 72 upon the wire 12. The bracket or carrying member 74 is further pivotally affixed to a vertical positioning member 76 as indicated at reference numeral 79. This positioning member 76 generally comprises an elongate bar having a plurality of openings 78 which are releasably engageable over a post or hanger bar 80 suitably affixed to the position 10*a* of the apparatus 10. Consequently, the mounting bracket or bar 74 and gas burner 70 carried thereon may be pivotally moved in a generally vertical direction for selectively applying the flame 72 to the wire 12, as indicated in phantom line in FIG. 5. The position of the flame 72 at the entrance to the pads 44 and 46 is further adjusted by means of a suitable threaded screw member threadably engaged with a member 84 on the bracket member 74. This screw 82 extends through the member 84 to engage an exterior surface of the pivotally mounted burner 70. Accordingly, the nut and bolt 71, 71*a* may be loosened somewhat to allow pivoting of the burner 70 to the desired position. Thereafter, the screw 82 is threadably moved into engagement with the surface of the burner 70 and the nut and bolt 71, 71***a* retightened to maintain the burner 70 in the desired position. A suitable gas supply line 86 enters the gas burner 70, and may be fed by a suitable gas supply (not shown).

In operation, then, the burner 70 directs a flame 72 upon the wire 12 immediately prior to its entrance to the water quenching tank 48 through the wiping and sealing pads 44, 46. The adjustment screw 50 and pad holding member 52 cooperate to provide a suitable amount of pressure for the described wiping and sealing engagement of the pads 44 and 46 with the wire 12. The wire 12 with its zinc coating maintained in a molten condition then passes through the water quenching tank 48 to achieve a bright finish on the finished wire 12. Thereafter, the wire is passed through a conventional cooling trough 24 and collected on a conventional take up reel 28. Advantageously, the provision of adjustable pressure for the pads 44 and 46 maintains a substantially even coating of molten zinc on the wire 12, while substantially preventing any leakage of water from the quenching bath 48 into the molten zinc bath 14 therebelow. Further, the provision of the heating means 66, as well as the described apparatus for the proper positioning thereof, assures not only that the zinc will remain in molten condition upon entering the water quench 48, to achieve a bright finish as desired, but also that any build up of molten material wiped by the pads 44 and 46 will not solidify causing a stopping or breakage of the wire in the apparatus 10.

While a preferred embodiment has been illustrated and described herein the invention is not limited thereto. On the contrary it is intended to include such alternatives, modifications or changes as may become apparent to those skilled in the art insofar as they fall within the spirit and scope of the appended claims.

The invention is claimed as follows:

1. Apparatus for obtaining a bright finish on zinc galvanized wire comprising: water quenching bath means for quenching the wire while the zinc coating is still in a molten condition, said water quenching means being mounted for receiving said wire following its passage through a molten zinc bath, burner means interposed between the water quenching means and the molten zinc bath and directed at the wire for maintaining the zinc coating on the wire in a molten condition until the wire enters the water quenching means, and means interposed between said water quenching means and said burner means for substantially preventing water from the quenching means from leaking into the zinc bath.

2. In an apparatus for galvanizing wire and including feed and take up reels for passing wire continuously through the apparatus, a molten zinc bath, means for passing the wire through the bath and means for cooling the wire prior to collection thereof on the take up reel, the improvement comprising means for obtaining a bright finish on the galvanized wire, said improvement comprising: water quenching bath means disposed adjacent the exit point of the wire from the molten zinc bath, means for substantially preventing leaking of water from the water quenching bath means into the molten zinc bath, and burner means interposed between said water quenching bath means and said molten zinc bath and directed at the wire for causing the zinc coating on the wire to remain in a molten condition until it enters the water quenching bath means.

3. The apparatus according to claim 1 or claim 2 wherein said means for preventing leaking of water from said water quenching bath means includes wiping pad means positioned for grippingly engaging the wire at the entrance of said water quenching bath means and means adjustable for urging the wiping pad means into engagement with the wire for sealing said water quenching bath means against leakage.

4. Apparatus according to claim 3 wherein said water quenching bath means comprises a tank, water supply means feeding said tank and level control means for maintaining a constant level of water circulating through said tank.

5. Apparatus according to claim 1 or claim 2 wherein said burner means comprises a gas burner producing a flame and positioning means adjustable for positioning said burner with respect to said wire so as to maintain said flame from said burner on the wire.

* * * * *